US008869548B2

(12) United States Patent
Piccione

(10) Patent No.: US 8,869,548 B2
(45) Date of Patent: Oct. 28, 2014

(54) COIL WITH BUILT-IN SEGMENTED PAN COMPRISING PRIMARY AND AUXILIARY DRAIN PANS AND METHOD

(75) Inventor: David Piccione, Humble, TX (US)

(73) Assignee: Aspen Manufacturing, LLC., Humble, TX (US)

( * ) Notice: Subject to any disclaimer, the term of this patent is extended or adjusted under 35 U.S.C. 154(b) by 767 days.

(21) Appl. No.: 13/184,532

(22) Filed: Jul. 16, 2011

(65) Prior Publication Data

US 2011/0265508 A1 Nov. 3, 2011

Related U.S. Application Data

(63) Continuation-in-part of application No. 12/174,813, filed on Jul. 17, 2008.

(60) Provisional application No. 60/963,767, filed on Aug. 7, 2007.

(51) Int. Cl.
*F25D 21/14* (2006.01)
*F24F 13/22* (2006.01)
*F28F 17/00* (2006.01)

(52) U.S. Cl.
CPC ..... *F24F 13/222* (2013.01); *F28F 17/005* (2013.01)
USPC ..... 62/291

(58) Field of Classification Search
CPC .. F24F 13/222; F24F 2013/227; F28F 17/005
USPC ..... 62/150, 285, 286, 291, 155, 288
See application file for complete search history.

(56) References Cited

U.S. PATENT DOCUMENTS

| | | | | |
|---|---|---|---|---|
| 3,596,475 | A * | 8/1971 | Berger | 62/285 |
| 3,678,993 | A | 7/1972 | Pierce | |
| 4,385,505 | A * | 5/1983 | Umezu et al. | 62/285 |
| 4,665,806 | A | 5/1987 | Martin, Sr. | |
| 4,907,420 | A * | 3/1990 | Mahanay et al. | 62/291 |
| 5,062,280 | A | 11/1991 | Martin, Sr. | |
| 5,152,154 | A * | 10/1992 | Sullivan | 62/291 |
| 5,284,027 | A | 2/1994 | Martin, Sr. | |
| 5,511,386 | A * | 4/1996 | Russ et al. | 62/285 |
| 5,664,431 | A | 9/1997 | Martin, Sr. | |
| 5,715,697 | A * | 2/1998 | Rust et al. | 62/286 |
| 5,904,053 | A * | 5/1999 | Polk et al. | 62/285 |
| 5,927,096 | A | 7/1999 | Piccione | |
| 5,964,370 | A * | 10/1999 | Rust et al. | 220/571 |
| 5,987,909 | A | 11/1999 | Martin, Sr. | |

(Continued)

FOREIGN PATENT DOCUMENTS

EP 1715256 A2 * 10/2006 ..... F24F 13/22

*Primary Examiner* — Frantz Jules
*Assistant Examiner* — Emmanuel Duke
(74) *Attorney, Agent, or Firm* — Kenneth L. Nash

(57) ABSTRACT

An air-conditioning system provides a segmented pan with a primary drain segment and a built in auxiliary drain pan segment to receive overflow condensate from the primary drain pan and drains through auxiliary drain lines. The built-in auxiliary drain pan and primary drain pan are plumb with respect to each other and are secured together and/or monolithic. The assembly construction thereby provides reduced time and costs associated with storing, transporting, installing, leveling, and plumbing individual components.

20 Claims, 4 Drawing Sheets

(56) References Cited

U.S. PATENT DOCUMENTS

| | | | | |
|---|---|---|---|---|
| 6,276,443 | B1 | 8/2001 | Martin, Sr. | |
| 6,519,966 | B1 | 2/2003 | Martin, Sr. | |
| 6,895,770 | B1 * | 5/2005 | Kaminski | 62/285 |
| 2002/0000093 | A1 * | 1/2002 | Lea | 62/150 |
| 2002/0124582 | A1 * | 9/2002 | Oakner et al. | 62/150 |
| 2003/0221439 | A1 * | 12/2003 | Bush et al. | 62/285 |
| 2005/0047974 | A1 | 3/2005 | Martin, Sr. | |
| 2005/0109053 | A1 * | 5/2005 | Eom et al. | 62/285 |
| 2005/0109055 | A1 | 5/2005 | Goetzinger | |

* cited by examiner

COIL WITH BUILT-IN SEGMENTED PAN COMPRISING PRIMARY AND AUXILIARY DRAIN PANS AND METHOD

This application is a continuation-in-part application of U.S. application Ser. No. 12/174,813, which was filed Jul. 17, 2008, and claims benefit of U.S. provisional application No. 60/963,767, filed on Aug. 7, 2007. U.S. application Ser. No. 12/174,813 and U.S. provisional application No. 60/963,767 are incorporated herein by reference.

BACKGROUND OF THE INVENTION

1. Field of the Invention

The present invention relates generally to air-conditioning systems and, more particularly, to a coil housing wherein multiple drain pans such as primary and overflow drain pans are built into a segmented pan, which avoids the need to individually build and plumb the auxiliary drain pan or other drain pans.

2. Description of the Prior Art

Generally, refrigeration systems employ an evaporator coil, condenser, fluid control device, compressor, and motor-driven fan, which carries air across evaporator coils. The most common type of air conditioning system is the "split" system, also called a "central" air conditioning system where the condenser is located outside and the evaporator is located inside.

In the split system, the condenser cools the refrigerant using the ambient air outside of the home (or other conditioned space). That refrigerant is then carried into the home where it passes through the evaporator coils. Inside the air handling unit (AHU), a motor-driven fan passes air from within the conditioned space over the coils, transferring heat from the inside air to the coils thereby cooling the conditioned space. This system is favored in humid climates for its ability to dehumidify the conditioned space. During the refrigeration cycle, moisture condenses on the evaporator coils and drips off within the AHU. This condensation is typically recovered by a drain pan and disposed of via a drain line to the outside or a plumbing system.

Drain lines can become occluded by mold or other microbial growth, rust, or debris, resulting in overflow of the drain pan. AHUs are often installed in residential attics, where overflows can result in considerable damage to a home's interior. A number of methods have been developed to prevent such damage.

For example, use of an overflow drain pan for various components of heating and cooling systems is well known. It has long been the practice of installers to fashion a suitable system of drain pans when installing a coil. This practice requires significant additional time and cost over the cost of the coil.

One installation method includes a secondary drain line installed slightly higher on the drain pan than the primary drain line to act as a backup in case the primary becomes occluded. Examples employing this method include, U.S. Pat. No. 5,715,697 to Rust et al., U.S. Pat. No. 5,904,053 to Polk et al., Pub. No. 20050109055 by Goetzinger et al., and U.S. Pat. No. 5,987,909 to Martin, Sr.

U.S. Pat. No. 5,715,697, issued to Rust et al. on Feb. 10, 1998, entitled "Condensate Pan with Minimal Residual Condensate," discloses a condensate pan adapted for use in either a left or right horizontal fan coil installation, including left and right mirror image sides interconnected with a central section having on its lower surface a riser near one end, and each of the halves having a drainage opening on the other end, such that when the evaporator coil is placed in the condensate pan, the pan is tipped about the riser to lower one side and raise the other, depending on whether its a left or right horizontal installation, such that drainage occurs from the lower side drainage opening. The drainage opening is so located with respect to the floor of the pan that, when a drainpipe is threadably connected thereto, its lower inner surface is disposed vertically below the pan floor.

U.S. Pat. No. 5,904,053, issued to Polk et al. on May 18, 1999, entitled "Drainage Management System for Refrigeration Coil," discloses a refrigeration system including an evaporator coil with a drain pan having alternative drain openings which receive movable primary and secondary drain plugs. A drain pan for use with horizontal A-coils is provided with alternative drain pan openings permitting a variety of configurations whereby the evaporator coil may be oriented in the space conditioning system depending upon on-site conditions. A combination horizontal coil support and drainage duct with coil baffle provides a channel for communication of drainage fluid from the coil to the drain pan.

U.S. Publication No. 2005/010,9055, published May 26, 2005 discloses a drain pan for capturing condensate from a cooling coil in an air conditioning system. The pan includes troughs for collecting condensate and for channeling the condensate to the front part of the pan where the drain openings are located. A back trough has a central hump to enhance the flow of condensate from the back trough in both directions into opposed side troughs. The side troughs are sloped from back to front to conduct the condensate into a front trough to facilitate drainage from the pan. The lowermost portion of the front trough region is defined by a relatively narrow, non-flat area to reduce the amount of condensate residue in the pan.

U.S. Pat. No. 5,987,909, issued to Martin, Sr. on Nov. 23, 1999, entitled "Air Conditioner Drain Pan," discloses a multi-pan for an air conditioning system which has a coil positionable in one of three orientations, the multi-pan includes, in certain aspects, a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan the bottom pan can be for an A (or V) coil with an air flow space therethrough, or for an M-coil with two air flow spaces therethrough and a middle pan part.

While this method consists of three individual drain pans, only one is utilized in any single orientation of the coils. Therefore, no redundancy is achieved.

Any of these methods, however, cannot address additional problems where drain pans can rust or overflow if the evaporator is being thawed after a recent system freeze. In response to these problems, installers have employed a second, auxiliary drain pans outside, and beneath, the AHUs to catch overflow from the primary drain pan. An example of this method includes, U.S. Pat. No. 6,895,770 to Kaminski.

U.S. Pat. No. 6,895,770, issued to Kaminski on May 24, 2005, entitled "Condensate Secondary Pan for a Central Air Conditioner System," discloses a secondary condensate pan for a central air conditioning system whereby overflow protection of the primary condensate removal system for a fan coil unit of a central air conditioning system is realized. The secondary pan is positioned directly beneath the primary pan of the central air conditioning system to convey condensate safely outside an enclosure should the primary pan overflow due to clogging of the primary drain line, or leak due to cracks or fissures formed in the primary pan. The condensate secondary pan has a predetermined girth sufficient to extend laterally beyond the primary pan of a conventional fan coil unit. The condensate secondary pan also has a bottom panel which is frustoconical in shape, thus minimizing the pooling of condensate on its surface as well as an integral drain pipe connecting means, thereby eliminating the need for a superfluous user supplied connecting means which is typically made of metal and thus is susceptible to corrosion.

While more redundant, this cited method requires the additional cost and time associated with, purchasing, storage, transporting, installation, and plumbing the additional components. Additionally, the external auxiliary drain pans must be leveled and plumbed separately or they could also overflow.

The same principles described above apply in a heat pump system like the one disclosed in U.S. Pat. No. 6,519,966. U.S. Pat. No. 6,519,966, issued to Martin, Sr., entitled "Air conditioning and Heat Pump System," discloses an air treatment system having an outer heat exchange coil, an inner heat exchange coil spaced-apart from and encompassed by the outer heat exchange coil, seal structure positioned with respect to both coils so that air pulled through the air treatment system by air movement apparatus may flow through the inner heat exchange coil without flowing through the outer heat exchange coil; and in one aspect, an air treatment system having an outer heat exchange coil; an inner heat exchange coil within the outer heat exchange coil; the inner coil spaced-apart from the outer heat exchange coil; the inner heat exchange coil and the outer heat exchange coil defining an inner chamber therebetween; the inner chamber positioned so that air exhaust apparatus above the inner heat exchange coil moves air into the inner chamber for exhausting therefrom by the air exhaust apparatus; air flowing from outside the outer heat exchange coil, through the outer heat exchange coil, and into the inner chamber; and air flowing from outside the housing between spaced-apart ends of the inner heat exchange coil to within the inner heat exchange coil, through the inner heat exchange coil, and into the inner chamber.

U.S. Pat. No. 5,062,280, issued Nov. 5, 1991, to Martin, Sr. discloses an air conditioning apparatus with an enclosure which both houses a conditioning coil and serves as a plenum for transferring air to one or more conduits. In one aspect, vanes of the coil or coils are oriented to direct air toward openings in the plenum. An enclosure serves as a coil housing and as a plenum.

U.S. Pat. No. 6,276,443, issued Aug. 21, 2001, to Martin, Sr. discloses an air conditioning coil system having a first and a second outside tubing slab, a first and a second inside tubing slab, the inside tubing slabs positioned between the outside tubing slabs, a top of the first outside tubing slab contacting a top of the first inside tubing slab, a top of the second outside tubing slab contacting a top of the second inside tubing slab, and a bottom of the first inside tubing slab contacting a bottom of the second inside tubing slab, each tubing slab having a plurality of spaced-apart heat exchange fins, each outside tubing slab having a plurality of spaced-apart tubing rows extending through the plurality of heat exchange fins of the corresponding outside tubing slab, and each inside tubing slab having at least one tubing row extending through the plurality of heat exchange fins of the corresponding inside tubing slab. The air conditioning coil system wherein the at least one tubing row of each inside tubing slab is one row less than the number of tubing rows of the plurality of spaced-apart tubing rows in one of the outside tubing slabs.

U.S. Pat. No. 6,664,431, issued Sep. 9, 1997, to Martin, Sr. discloses a drain pan system for receiving water condensed on and flowing from an air conditioning coil, including a pan with a pan member for receiving and holding water from the coil, and the pan member having a side lip for connecting to an adjacent pan, the adjacent pan adjacent the coil and disposed at an angle to the pan member. In one aspect, the drain pan is used with the coil which is generally in a V-shape when viewed from an end thereof. In one aspect, the system includes a lateral pan or pans sealingly connectible to the adjacent pan and to which the pan member is sealingly secured.

U.S. Pat. No. 5,284,027, issued Feb. 8, 1994, to Martin, Sr. discloses a drain pan with an opening or openings through which air flows to a coil and a coil which, in one embodiment, has a cover plate so air flowing through a drain pan flows between vanes of a coil rather than out from an opening at an end of the coil; such a pan in combination with such a coil; and a system with such a coil-pan combination which uses a single pan for multiple orientations of the coil-pan combination in both horizontal flow, up-flow, and down-flow systems.

U.S. Pat. No. 4,665,806, issued Sep. 12, 1985, to Martin, Sr. discloses an air distributor for mounting in a duct outlet in an air conditioning heating and ventilation system is provided to direct the flow of air within the conditioned space. A frame is mounted within the conditioned space and in fluid communication with the outlet of the duct. The frame has an opening therethrough. A deflection member is movably mounted to the frame from an open position wherein the air can flow into the conditioned space to a closed position where essentially no air flows into the conditioned space. The deflection member is selectively adjustable in intermediate positions between the open and closed positions. A diverter is provided with the deflection member and is accessible for adjustment from the conditioned space to selectively direct the air flow between the frame and deflection member into the conditioned space in a two way, three way and four way pattern.

U.S. Patent Publication No. 20050047974, published Mar. 3, 2005, to Martin, Sr., discloses a plenum system with air flow structure for enclosing a coil of an air treatment system. The air flow structure in certain aspects has a container with at least two openings for air flow therethrough, the container having an interior surface, and the interior surface having ultraviolet-resistant material thereon; and methods for using such an air flow structure.

U.S. Pat. No. 5,927,096, entitled "Air conditioning System and Method," issued to Piccione, which is incorporated herein by reference, discloses an air conditioning apparatus and method which provides for a bi-flow coil housing having air flow connection ends that are substantially identical. These coil housing features allow the coil housing to have either a right-hand or left-hand coil configuration to thereby allow installation flexibility so that the coil refrigerant and drain connections are readily available. In furtherance of this feature, a transition member and a plenum have substantially similar or identical ends for connection to the coil housing and may be connected to either end of the coil housing. Because there is only one end of the transition member that will vary in size thereby greatly reducing the number of different possible combinations of connection sizes the transition member must accord, a plurality of prefabricated transition members are preferably stored in the warehouse based on the type of heater. The use of a prefabricated transition member specifically designed for the specific type of heater and coil housing provides a quicker and precision fit there between.

The solutions to the above described and/or related problems have been long sought without success. Consequently, there remains a need to provide equipment and methods for coils and mounting methods. Those of skill in the art will appreciate the present invention, which addresses the above problems and other significant problems uncovered by the inventor that are discussed hereinafter.

SUMMARY OF THE INVENTION

It is an object of the invention to provide an improved air conditioning system.

Accordingly, an embodiment of an air-conditioning system in accordance with the present invention may comprise components such as an evaporator coil, a housing surrounding the evaporator coil, the housing defining an input for airflow, and a segmented pan. A first segment of the segmented pan may comprise a primary drain pan positioned to receive the condensate from the evaporator coil. A second segment of the segmented pan may comprise an auxiliary drain pan, which receives the condensate only after an overflow level of condensate is reached in the primary drain pan.

The primary drain pan and the auxiliary drain pan in the segmented pan are plumb with respect to each other in that they are positioned for operation once they are secured together and/or made monolithically in whole or part. The entire assembly may be plumbed for leveled only once rather than requiring the drain pans to be individually level as in the prior art. In fact, the drain pans preferably cannot be individually leveled or plumbed. A third segment of the segmented drain pan may comprise an evaporator drain pan which receives the condensate and then drains into the primary drain pan.

The primary drain pan may comprise a primary drain pan bottom, the evaporator drain pan may comprise a evaporator drain pan bottom, with the primary drain pan bottom being at a lower elevation than the evaporator drain pan bottom. The primary drain pan may be positioned at one side of the evaporator coil drain pan. In one embodiment, the auxiliary pan is positioned on opposite side of the primary drain pan from the evaporator coil drain pan.

The air conditioning system may further comprise a primary drain outlet and a secondary drain outlet. The primary drain outlet is oriented or configured to drain condensate that accumulates on the primary drain pan bottom, while the secondary drain outlet is oriented, connected, and/or is otherwise configured to drain condensate only after the condensate accumulates to a secondary level that is higher than the primary drain pan bottom. However, the secondary level is lower than the overflow level.

In one embodiment, the evaporator coil drain pan bottom is at a higher level after installation of the air-conditioning system than the primary drain pan bottom. In another embodiment, the secondary level may be approximately level with the evaporator drain pan bottom or more generally between one third and two thirds of the distance to the overflow limit.

The air conditioning system may further comprise an auxiliary drain outlet. In one embodiment, the auxiliary drain pan may comprise a width of approximately equal to a width of the auxiliary drain outlet.

In one embodiment, the primary drain pan bottom and the evaporator drain pan bottom being continuous or monolithic. In one embodiment, the auxiliary drain pan bottom for the auxiliary drain pan, the primary drain pan bottom, and the evaporator drain pan bottom are continuous but may be at different levels.

In one embodiment, drain holes for the auxiliary drain pan are formed in a plenum, which connects to housing. In another embodiment, drain holes for the auxiliary drain pan are formed in the coil housing and/or the plenum.

In one embodiment, the primary drain pan and the auxiliary drain pan comprises one or more of metal, plastic, fiberglass, and composite materials. The primary drain pan in the auxiliary drain pan may be molded in one piece and/or welded so as to be in one piece.

In one possible embodiment, the primary drain pan is positioned closer to the evaporator coil than the auxiliary drain pan.

The present invention provides a method for making an air conditioning system that produces condensate, which may comprise steps such as providing an evaporator coil, mounting a housing in surrounding relationship to the evaporator coil, and defining at least one input for airflow through the housing.

Other steps may comprise providing a segmented pan with a primary drain pan within the housing positioned to receive the condensate from the evaporator coil and an auxiliary drain pan within the housing operatively in communication with the primary drain pan for receiving the condensate from the primary drain pan only after an overflow level of the condensate is reached in the primary drain pan.

The method may comprise providing that a drain pan bottom of the auxiliary drain pan is monolithic with a bottom of the primary drain pan. The primary drain pan and the auxiliary drain pan are secured together in a manner so that plumbing or leveling for is not necessary individually for each of the primary drain pan and the auxiliary drain pan. In other words, both the auxiliary drain pan and the primary drain pan are simultaneously plumbed or leveled. In one embodiment, the primary drain pan and the auxiliary drain pan and/or the evaporator coil drain pan are molded in one piece. The method may comprise providing an evaporator coil pan, which drains into the primary drain pan, whereby the primary drain pan, the auxiliary drain pan, and the evaporator coil drain pan are plumb with each other so that all three are simultaneously leveled or plumbed during installation as necessary. In other words, all three pants are affixed together and cannot be individually plumbed with respect to each other. In one embodiment, the evaporator coil drain pan, the primary drain pan, and the auxiliary drain pan are side-by-side within the segmented drain pan, which may be provided as a single unit and/or being continuous and/or the monolithic.

The method may comprise providing that the evaporator coil pan comprises a bottom which has a different level than a bottom of the primary drain pan. The evaporator coil pan may be inclined to drain into the primary drain pan.

In another embodiment, an air conditioning system in accord with the present invention may comprise an evaporator coil and a housing surrounding the evaporator coil wherein the housing defines at least one input for airflow therethrough. A primary drain pan may be formed within the housing positioned to receive condensate from the evaporator coil. At least one auxiliary drain pan is formed within the housing for receiving overflow from the primary drain pan. The primary drain pan and the auxiliary drain pan may be plumbed or leveled with respect to each other during manufacturing to avoid the need to perform this function twice. In other words they cannot be plumbed individually during installation because they are affixed together.

In one embodiment, the auxiliary drain pan may be utilized as the bottom or part of the bottom of the housing. Alternatively, the auxiliary drain pan may be positioned above a bottom of the housing. In one embodiment, the auxiliary drain pan may be positioned at least partially directly beside the primary drain pan to receive overflow from the walls of the primary drain pan.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

The present invention provides an air conditioning system with drain pan assembly 10, hereinafter referred to as assembly 10, which may be utilized to more quickly and efficiently install the coil and related components used in an air-conditioning system. In one embodiment of the present invention, assembly 10 provides a single air conditioning housing to be installed, leveled and plumbed, having the full redundancy of an auxiliary pan, but without the need for an installer to fabricate and/or install one in the field. An air conditioning housing with integral drain pans and auxiliary drain pans in accord with the present invention addresses all the problems cited above with none of the aforementioned disadvantages.

Figure 1:
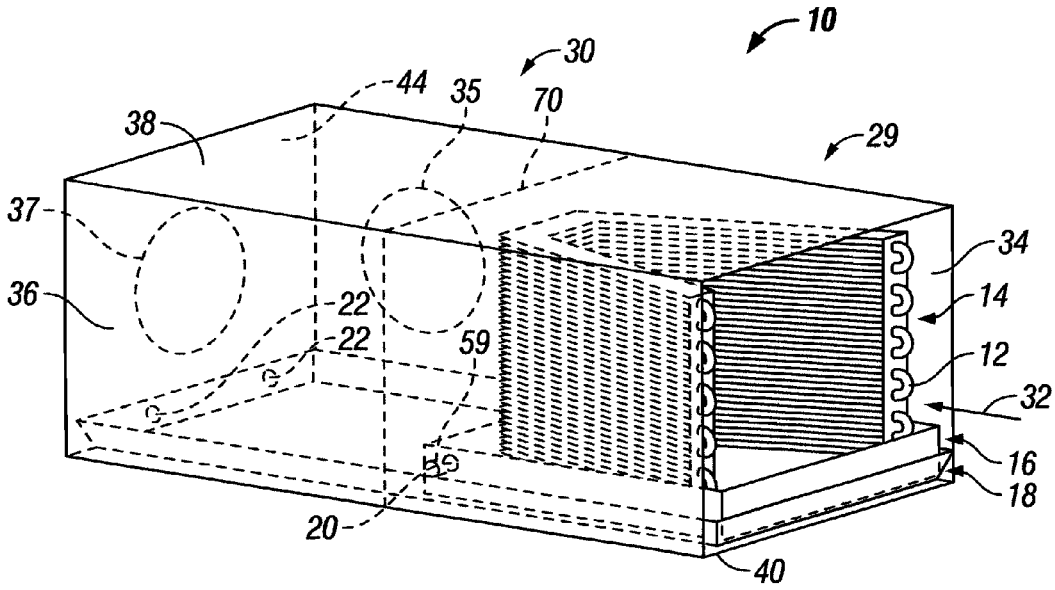
FIG. 1 is a perspective view, partially in hidden lines, of an evaporator coil with plenum, primary, and auxiliary drain pans attached, wherein drain holes from the primary and auxiliary drain pan are shown in accord with a possible embodiment of the present invention.

FIG. 1 illustrates one possible embodiment of an air conditioner with drain pan assembly 10. Many configurations of assembly 10 are possible. FIG. 1 shows one possible configuration of evaporator coil 14, which is in a horizontal V-shaped configuration. In this embodiment, coil housing 29 may incorporate coil 14. Coil 14 may comprise coils and fins 12 as is well known in the art. Other embodiments might possibly comprise an I-shaped, V-shaped, W-shaped, or other shapes of the evaporator coil in a horizontal configuration. Accordingly, FIG. 1 is an example configuration and is not intended to be comprehensive of every configuration contemplated.

Assembly 10 may comprise coil housing 29 and/or plenum 30. Plenum assembly 30 may be interconnectable to coil housing 29 utilizing, for example, junction or connection 70. Coil housing 29 and plenum portion 30 may also be reversible with respect to each other. Alternatively, coil housing 29 and plenum 30 may comprise a one-piece construction housing. Thus, plenum assembly 30 may or may not incorporate or be incorporated with coil housing 29 and/or evaporator coil 14. In other words, the air conditioning housing may comprise coil housing 29 and/or plenum 30. The air conditioning housing components, such as coil 14 and/or coil housing 29 and/or plenum 30, may be secured together, separate, and/or formed in a one-piece construction, as desired.

In the embodiment of FIG. 1, air may enter assembly 10 through opening or air intake 34 as indicated by airflow arrow 32. Air then passes across evaporator coil 14, cooling the air. Air may be driven by a fan (not shown) through coil 14 into the plenum assembly 30. This cooled air then passes out of assembly 10 through at least one plenum air outlet, such as air outlets 35 and 37 or other outlets, which may be formed in walls 36 and 44. The cooled air is carried into a house or building to provide an air-conditioned space therein.

Air outlets, such as air outlet 37 on rear wall 44 or air outlet 35 on sidewall 36, may be provided or formed in plenum 30. Air may exit through any of the plenum sides as required. Plenum 30 may be comprised of material that is easily cut to form outlets as needed for the particular requirements of the air conditioning system for a particular house or building.

Heat transfers from the air through evaporator coil 14 and ultimately into the refrigerant. During this process, moisture condenses out of the air. Evaporator coil 14 is positioned above primary drain pan 16 and, depending on the configuration, over a portion or all of auxiliary drain pan 18. Auxiliary drain pan 18 may or may not extend over the entire length of assembly 10.

As primary drain pan 16 fills, the primary means of removing the recovered condensate is through the primary plenum drain holes 20. If an overflow occurs, such as if drain holes 20 become blocked, then condensate is recovered by a redundant system, auxiliary drain pan 18. The condensate may then be removed via the auxiliary plenum drain holes, such as auxiliary drain holes 22. Prior to any damage, the user may note that service is required when condensate flows from the auxiliary drain lines and/or other sensors may be available for this purpose.

In the illustrated embodiment, auxiliary drain pan 18 may preferably slope towards and drain out of back wall 44 through the auxiliary plenum drain holes 22. Other embodiments may comprise other drain holes, drain lines, and/or nozzles to carry condensate from auxiliary drain pan 18 and/or to carry condensate from primary drain pan 16 to one or more auxiliary drain pans 18. Furthermore, auxiliary drain pan 18 could be sloped towards, and drain out of, any of the slides 36, rear wall 44, or bottom 40. Alternatively, auxiliary drain pan 18 may not be sloped and may have a flat bottom.

Figure 2:
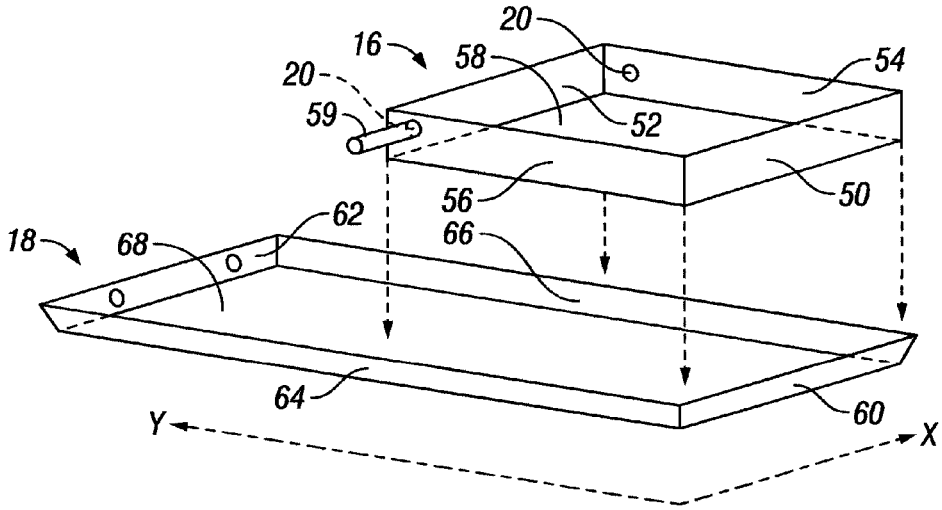
FIG. 2 is a perspective view, partially in hidden lines, showing a primary and auxiliary drain pan in accord with a possible embodiment of the present invention.

FIG. 2 illustrates one possible embodiment of the integral drain pans. FIG. 2 is shown conceptually and actual construction may be of many different types and/or involve molds or the like. In this embodiment, primary drain pan 16 is comprised of front wall 50, rear wall 52, two side walls 54, 56, and a bottom 58. Primary drain pan 16 may be comprised of metal, plastic, fiberglass, combinations thereof, and/or any suitable materials. Primary drain pan 16 may overflow through primary plenum drain holes 20 into one or more drain lines 59.

Additionally, FIG. 2 shows possible relative dimensions of primary drain pan 16 and auxiliary drain pan 18. In one embodiment, the X and Y dimensions of the primary drain pan 16 may be less than those of the auxiliary drain pan 18. For example, primary drain pan 16 may fit or nest within the auxiliary drain pan 18. In the event of an overflow of primary drain pan 16, condensate flows over the walls 50, 52, 54, and 56 of the primary drain pan into the auxiliary drain pan 18. However, one or more walls may be lower than others to direct flow in a particular direction. As well, channels or openings may be formed and utilized to direct water from primary drain pan 16 to auxiliary drain pan 18. Auxiliary drain pan 18 and/or primary drain pan 16 may comprise a segmented pan, multiple pans, and/or channels therein to hold and/or direct flow of excess condensate.

Motivated by gravity, condensate drains out of the auxiliary drain pan holes 22. In the illustrated embodiment, the auxiliary drain pan holes 22 are located in the auxiliary drain pan rear wall 62. Other embodiments, however, may comprise auxiliary drain pan holes 22 in any of the drain pain walls 60, 62, 64, and/or 66. Other embodiments may comprise drain lines, tubes, nozzles, or valves, which interconnect with or lead from primary drain pan 16 and/or auxiliary drain pan 18.

Figure 3A:
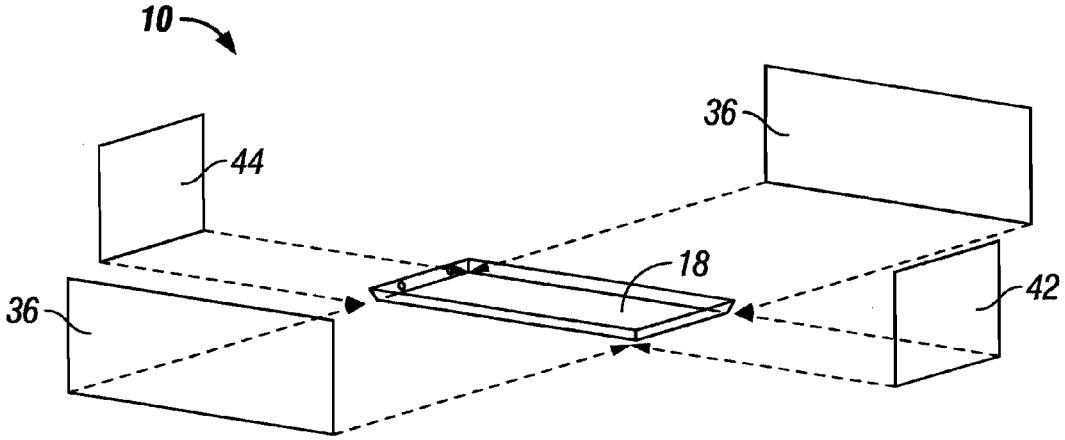
FIG. 3A is a perspective view, in exploded configuration, showing an auxiliary drain pan integration with the plenum and/or coil and/or air conditioning housings in accord with a possible embodiment of the present invention.
Figure 3B:
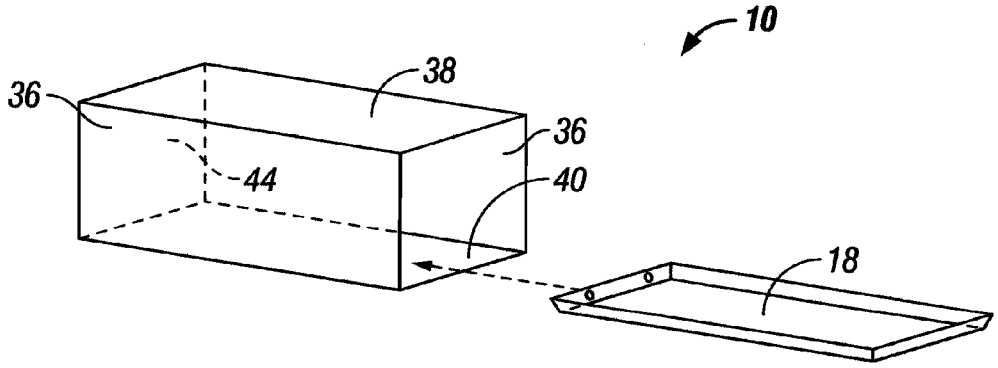
FIG. 3B is a perspective view, partially in hidden lines, showing an auxiliary drain pan integration with the plenum and/or coil and/or air conditioning housings in accord with a possible embodiment of the present invention.

FIG. 3A and FIG. 3B illustrate further possible embodiments for assembly 10. In FIG. 3B, auxiliary drain pan 18 is a separate component that may be inserted onto the upper surface of bottom 40 of assembly 10 or some bottom portion of assembly 10. In FIG. 3B, assembly 10 (and/or coil housing 29 and/or plenum 30) might comprise a front wall 42, rear wall 44, top 38, bottom, and two sidewalls 36. Front wall 42 and rear wall 44 are shown for reference but may or may not be present and/or may be removable and/or may be suitable for modification or interconnection with coil housing 29 or plenum 30, depending on the configuration. As discussed hereinbefore, there are many possible configurations of assembly 10.

In FIG. 3A, the assembly 10 (and/or coil housing 29 and/or plenum 30) front 42, rear 44, and side walls 36 are fastened to the auxiliary drain pan 18, such that a bottom of auxiliary pan 18 becomes bottom 40 of assembly 10 or some portion of assembly 10.

In other embodiments, evaporator coil 14 and primary drain pan 16 may be formed in coil housing 29 and then attached as indicated by (possible) junction 70 in FIG. 1. A portion of auxiliary drain pan 18 may be provided in plenum 30 and another portion in coil housing 29 whereupon the portions of auxiliary drain pan 18 are interconnected by interconnecting plenum 30 and coil housing 29. In another embodiment, primary drain pan 16, evaporator coil 14, and auxiliary drain pan 18 may also be inserted into plenum 30. It will be appreciated that many different variations are possible. The manufacturing of auxiliary drain pan 18 and primary drain pan 16 results in the effective leveling and plumbing of these pans to cooperate with each other. Thus, in one embodiment, the installer may level and plumb assembly 10 one time, and complete the job in significantly less time with a higher quality construction.

Materials for plenum 30 and coil housing 29 may comprise thick or thin soft insulation, thick or thin rigid metal, thick or thin soft metal, and/or a combination of materials best suited for the application of the assembly 10. At least one surface of the plenum assembly 30 may be made of easily cut material to form air outlet(s) 35, 37 and/or other outlets as needed.

The embodiments discussed above accomplish the goal of having a single, integrated, plenum-coil-drain pan assembly. This single assembly reduces the time and costs associated with storing, transporting, installing, leveling, and plumbing individual components. The auxiliary drain pan and primary drain pan are plumb or level with respect to each other and the housing of the air-conditioning system so that it is only necessary to level the entire system one time.

Figure 4A:
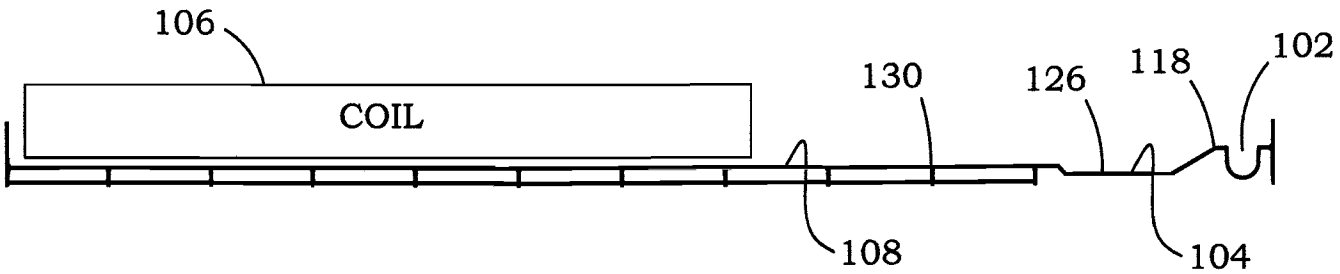
FIG. 4A is a side elevational view, in section, showing a one-piece drain pan with integrated primary and auxiliary drain pans in accord with one possible embodiment of the present invention.
Figure 4B:
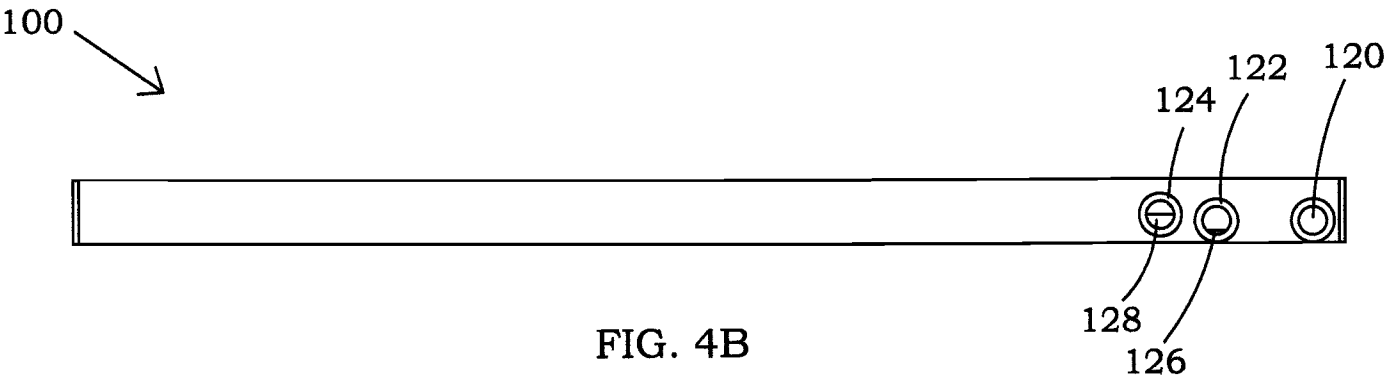
FIG. 4B is a side elevational view of the segmented drain pan of FIG. 4A taken externally from the drain pan, which the outlets from the primary and auxiliary drain pans in accord with one possible embodiment of the present invention.
Figure 5:
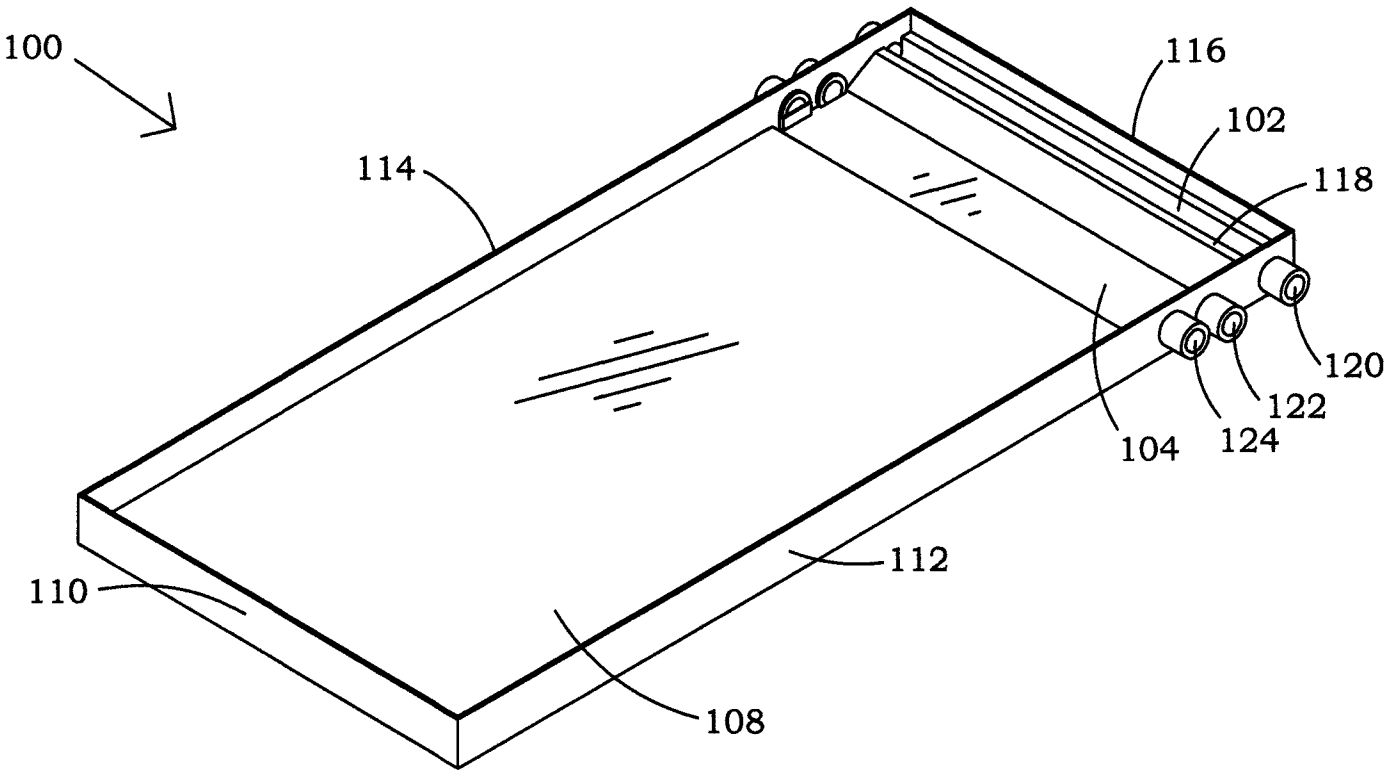
FIG. 5 is a perspective view of the one-piece drain pan of FIG. 4A and FIG. 4B with integrated primary and auxiliary drain pans in accord with one possible embodiment of the present invention.

FIG. 4A, FIG. 4B, and FIG. 5 show another possible embodiment of the present invention, namely segmented primary and auxiliary pan 100. Segmented primary and auxiliary pan 100 may be provided in a construction that requires only a single pan that comprises multiple sections, which comprise both auxiliary pan 102 and primary pan 104.

In one possible embodiment, coil 106 is positioned/supported in evaporator coil drain pan 108 directly below evaporator coil 106. Condensate received from coil 106 drains into primary pan 104, which is directly to the side and lower than the bottom 130 of evaporator coil drain pan 108. In this embodiment, auxiliary drain pan 102 is located to the side of primary drain pan 104 opposite from evaporator coil drain pan 108. Evaporator coil drain pan 108 may or may not be inclined towards primary drain pan 104. Preferably, there is no barrier between evaporator core drain plan 108 and primary drain pan 104.

Segmented primary and auxiliary pan 100 may or may not be monolithic construction. Something that is monolithic is something created in one piece, resembling a monolith such as an obelisk, molding, or the like. As used herein, the term monolithic signifies a segmented pan without any subcomponents, i.e. a non-modularized, non-componentized, non-dismantable (without cutting tools) without damage building block.

As well, certain components of different pans may be one piece or monolithic. For example, the bottom of the segmented hands may be continuous or monolithic while providing different levels whereupon surrounding walls 110, 112, 114, and 160 may be mounted to the one piece or continuous bottom. In this embodiment, coil pan 108 is essentially part of primary pan 104 and drains into or fills primary pan 104. In the present example, coil pan 108 has a bottom surface that is elevated as compared to the bottom surface of primary pan 104.

The relative size of auxiliary pan 102, primary pan 104, and coil pan 108 may be varied as desired. However in the example of FIG. 4A, FIG. 4B, and FIG. 5, auxiliary pan 102 is considerably smaller than primary pan 104 and/or coil pan 108. In this example, auxiliary pan 102 has a diameter, which is approximately the same as the diameter of auxiliary output 120.

Both primary pan 104 and auxiliary drain pan 102 are surrounded by walls 110, 112, 114, and 116, which are sufficiently high to hold a designed amount of water therein. If desired, coil housing 29 may be utilized to form one or more of the bottoms or sides of coil drain pan 108, primary drain pan 104, and/or auxiliary drain pan 102.

In this embodiment, overflow wall 118 is lower than walls 110, 112, 114, 116. Therefore, if outlets from primary drain pan 104 become clogged water will flow over wall 118 to empty into auxiliary pan 102. Overflow wall 118 may or may not comprise channels, grooves, openings, or the like if desired, to create an overflow level, once reached results in flow into auxiliary pan 102. Thus, over flow wall 118 may be higher than walls 110, 112, 114, 116 if openings are formed in wall 118, which create the desired overflow level.

In this example, as perhaps best shown in FIG. 4B, primary drain 122 and secondary drain 124 are utilized as outlets for primary pan 104. In this embodiment, primary drain outlet 122 begins to drain water that accumulates at or near the bottom 126 of primary pan 104. The opening of secondary drain 124 does not begin to drain until water rises considerably higher in primary pan 104 but well before water overflows from primary pan 104 into auxiliary pan 102. In this example, secondary drain outlet 124 may comprise a wall 128 that prevents flow until water fills primary pan 104 to approximately the level of the bottom 130 of coil pan 108. In this example, this level may be approximately ⅓ to ½ or more of the level of water before primary pan 104 overflows into auxiliary pan 102. In this way, corrosion in a pipe connected secondary drain 124 due to water, mold and/or rust does not occur as long as water flows into the pipe connected to primary drain 122. It will be appreciated, that secondary drain 124 could be located elsewhere such as in coil pan 108, or that multiple secondary drains could be utilized at different places in primary pan 104 and/or coil pan 108.

During operation, water will normally flow through primary drain 122, which empties primary pan 104. It will be appreciated that outlets may be provided on both sides of segmented primary and auxiliary pan 100, or elsewhere as desired. If these lines connected to primary drain outlet 122 become clogged, then condensate will drain through secondary drain outlet 124 once the level of water rises sufficiently. In case that both primary drain outlet 122 and secondary drain outlet 124 become clogged, or the lines connected thereto become clogged, condensate collects sufficiently to rise to the height of overflow wall 118 whereupon condensate flows into auxiliary pan 102, which may also be referred to as a trap, enclosure, section, or the like.

In this way, multiple outlets are provided which drain depending on the water level in primary drain pan 104. In this example, two different outlets connecting to primary drain pan 104 begin to flow at different water levels in primary drain pan 104. An even higher water level in primary drain pan 104 then causes auxiliary drain 122 begin to flow.

Segmented primary and auxiliary pan 100 may be manufactured in various ways and using various materials. If desired, segmented primary and auxiliary pan 100 may be molded using plastic, fiberglass, or other moldable materials. As well, segmented primary and auxiliary pan 100 may be constructed from metal that is welded, bolted, and/or otherwise secured together. Preferably, after assembly segmented primary and auxiliary pan 100 may be mounted within coil housing 29 and/or plenum 30. As discussed above, coil housing 29 and/or plenum 30 may be manufactured to comprise all or part of segmented primary and auxiliary pan 100 or segmented primary and auxiliary pan 100 may be separately manufactured and then inserted into coil housing and/or plenum 30. In this example, the bottoms of coil housing 108, primary pan 104, and auxiliary pan 102 are continuously formed but at different levels.

Accordingly, the present invention provides primary and auxiliary drain pan arrangements, which can be installed at one time, eliminating significant time and expense, while providing manufacturer level leveling and mounting between the primary and the auxiliary drain pans.

The disclosure and description of the invention above is illustrative and explanatory of a presently preferred embodiment of the invention and variations thereof, and it will be appreciated by those skilled in the art that various changes in the design, organization, order of operation, means of operation, equipment structures and location, methodology, and use of mechanical/electrical/software equivalents, as well as in the details of the illustrated construction or combinations of features of the various elements, may be made without departing from the spirit of the invention. While the terms "level", "higher", "elevation", and the like are used herein, they are intended to be the positions as installed as shown in the drawings are as intended to be used rather than relative positions that may change such as during transportation or storage of the air-conditioning equipment.

As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and still operate within the spirit of the invention as described hereinbefore and in the appended claims. It will be seen that various changes and alternatives may be used that are contained within the spirit of the invention.

Accordingly, because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. An air conditioning system which produces condensate, comprising:

an evaporator coil;

a housing surrounding said evaporator coil, said housing defining an input for airflow;

a segmented pan, a first segment of said segmented pan comprising a primary drain pan positioned to receive said condensate from said evaporator coil, and a second segment of said segmented pan comprising an auxiliary drain pan;

a primary drain outlet positioned in said primary drain pan to drain said primary pan;

an auxiliary drain outlet positioned in said auxiliary drain pan to drain condensate from said auxiliary drain pan;

an overflow wall that separates said primary drain pan from said auxiliary drain pan to prevent any condensate flow into said auxiliary pan until an overflow level of condensate is reached in said primary drain pan, said overflow wall being configured to then permit condensate to flow past said overflow wall into said auxiliary drain pan for draining through said auxiliary drain outlet, whereby said overflow level and said overflow wall each comprise a height at least above said primary drain outlet.

2. The air conditioning system of claim 1, wherein said primary drain pan and said auxiliary drain pan in said segmented pan are plumb with respect to each other and cannot be individually leveled during installation.

3. The air conditioning system of claim 1, further comprising an evaporator coil drain pan positioned below said evaporator coil which receives said condensate and then drains into said primary drain pan, said primary drain pan comprising a primary drain pan bottom, said evaporator coil drain pan comprising an evaporator coil drain pan bottom, said primary drain pan bottom being at a lower elevation than said evaporator coil drain pan bottom in a manner whereby said condensate drains from said evaporator coil pan bottom toward said primary pan bottom.

4. The air conditioning system of claim 1, further comprising a secondary drain outlet in said primary drain pan, said primary drain pan comprising a primary drain pan bottom, said primary drain outlet being configured to drain condensate that accumulates on said primary drain pan bottom, said secondary drain outlet being configured to drain condensate only after said condensate accumulates to a secondary level that is higher than said primary drain pan bottom, said secondary level being lower than said overflow level.

5. The air conditioning system of claim 4, further comprising an evaporator coil drain pan with an evaporator coil drain pan bottom, said evaporator coil drain pan bottom being at a higher level than said primary drain pan bottom, said secondary level being approximately level with said evaporator coil drain pan bottom.

6. The air conditioning system of claim 1, wherein said auxiliary drain pan comprises a width approximately equal to a width of said auxiliary drain outlet.

7. The air conditioning system of claim 1, further comprising an evaporator coil drain pan which receives said condensate and then drains into said primary drain pan, said primary drain pan comprising a primary drain pan bottom, said evaporator coil drain pan comprising an evaporator coil drain pan bottom, said primary drain pan bottom and said evaporator coil drain pan bottom being continuous without obstructions therebetween.

8. The air conditioning system of claim 7, further comprising an auxiliary drain pan bottom for said auxiliary drain pan, wherein at least two of said primary drain pan bottom, said evaporator coil drain pan bottom and said auxiliary drain pan bottom are continuous but at different levels.

9. The air conditioning system of claim 6, wherein drain holes for said auxiliary drain pan are formed in a plenum.

10. The air conditioning system of claim 1, wherein said auxiliary drain pan is positioned to a side of said primary drain pan.

11. The air conditioning system of claim 10, further comprising an evaporator coil drain pan which is positioned below said evaporator coil, said primary drain pan being positioned to an opposite side of said evaporator coil drain pan.

12. The air conditioning system of claim 1, wherein said primary drain pan and said auxiliary drain pan are monolithically constructed.

13. A method for making an air conditioning system that produces condensate, comprising steps of:

providing an evaporator coil;

mounting a housing in surrounding relationship to said evaporator coil;

defining at least one input for airflow through said housing;

providing a segmented pan comprising a primary drain pan positioned to receive said condensate from said evaporator coil and an auxiliary drain pan operatively in communication with said primary drain pan for receiving said condensate from said primary drain pan only after an overflow level of said condensate is reached in said primary drain pan;

providing a primary drain outlet positioned within said primary drain pan to drain condensate from said primary pan; and providing an auxiliary drain outlet positioned within said auxiliary drain pan to drain condensate only from said auxiliary drain pan and then only after said overflow level of said condensate is reached in said primary pan; and providing that said overflow level is at least higher than said primary drain outlet.

14. The method of claim 13, comprising providing that a drain pan bottom of said auxiliary drain pan is monolithic with a bottom of said primary drain pan.

15. The method of claim 13, comprising providing at least one secondary drain outlet in said primary drain pan beside said primary drain outlet, and providing that said primary drain outlet, said auxiliary drain outlet, and said secondary drain outlet are positioned so that each begins to drain at different levels of said condensate in said primary drain pan.

16. The method of claim 13, comprising providing that said primary drain pan and said auxiliary drain pan are molded in one piece.

17. The method of claim 13, comprising providing an evaporator coil pan, which drains into said primary drain pan.

18. The method of claim 17, comprising providing that said evaporator coil pan comprises a bottom which has a different level than a bottom of said primary drain pan.

19. An air conditioning system which produces condensate, comprising:

an evaporator coil;

a housing surrounding said evaporator coil, said housing defining an input for airflow;

a segmented pan, a first segment of said segmented pan comprising a primary drain pan positioned to receive said condensate from said evaporator coil, and a second segment of said segmented pan which comprises an auxiliary drain pan, a primary drain outlet to drain said primary pan;

an auxiliary drain outlet positioned in said auxiliary drain pan to drain condensate only from said auxiliary drain pan;

an overflow wall that separates said primary drain pan and said auxiliary drain pan, said overflow wall comprising a height at least above said primary drain outlet, said auxiliary drain pan being positioned to receive said condensate only after an overflow level of condensate is reached in said primary drain pan;

a secondary drain outlet, said primary drain pan comprising a primary drain pan bottom, said primary drain outlet being configured to drain any condensate that accumulates on said primary drain pan bottom, said secondary drain outlet being configured to drain condensate only after said condensate accumulates to a secondary level that is higher than said primary drain pan bottom, said secondary level being lower than said overflow level.

20. The air conditioning system of claim 19, further comprising a third segment of said segmented drain pan comprising an evaporator coil drain pan which receives said condensate and then drains into said primary drain pan, said primary drain pan comprising a primary drain pan bottom, said evaporator coil drain pan comprising an evaporator coil drain pan bottom, said primary drain pan bottom being at a lower elevation than said evaporator coil drain pan bottom.

* * * * *